US008607696B2

(12) United States Patent
Jensen et al.

(10) Patent No.: US 8,607,696 B2
(45) Date of Patent: Dec. 17, 2013

(54) BINDING APPARATUS

(75) Inventors: Kim Jensen, Roskilde (DK); Johan C. Gregersen, Bagsværd (DK)

(73) Assignee: JBJ Mechatronic ApS, Gentofte (DK)

( * ) Notice: Subject to any disclaimer, the term of this patent is extended or adjusted under 35 U.S.C. 154(b) by 159 days.

(21) Appl. No.: 12/743,710

(22) PCT Filed: Nov. 14, 2008

(86) PCT No.: PCT/EP2008/065566

§ 371 (c)(1),
(2), (4) Date: Aug. 2, 2010

(87) PCT Pub. No.: WO2009/065775

PCT Pub. Date: May 28, 2009

(65) Prior Publication Data

US 2010/0293902 A1 Nov. 25, 2010

(30) Foreign Application Priority Data

Nov. 20, 2007 (DK) ..... 2007 01644

(51) Int. Cl.
*B65B 13/28* (2006.01)
*B21F 15/04* (2006.01)

(52) U.S. Cl.
USPC ..... 100/31; 140/119; 140/93.6

(58) Field of Classification Search
USPC ..... 100/26, 31; 140/93 A, 93.6, 119; 53/138.6, 138.8
See application file for complete search history.

(56) References Cited

U.S. PATENT DOCUMENTS

| | | | | |
|---|---|---|---|---|
| 4,252,157 | A | 2/1981 | Ohnishi | |
| 4,362,192 | A | 12/1982 | Furlong et al. | |
| 5,657,799 | A | 8/1997 | Kusakari et al. | |
| 5,947,166 | A * | 9/1999 | Doyle et al. | 140/119 |
| 7,051,650 | B2 * | 5/2006 | Kusakari et al. | 100/31 |
| 7,143,792 | B2 * | 12/2006 | Ishikawa et al. | 140/119 |
| 7,255,135 | B2 * | 8/2007 | Ishikawa et al. | 140/119 |
| 2006/0157139 | A1 * | 7/2006 | Hoyaukin | 140/119 |

FOREIGN PATENT DOCUMENTS

| | | |
|---|---|---|
| CN | 1761796 | 4/2006 |
| EP | 0332532 | 9/1989 |
| EP | 0731238 | 9/1996 |
| EP | 0751270 | 1/1997 |
| EP | 0810153 | 12/1997 |
| EP | 0829596 | 3/1998 |
| EP | 1484249 | 12/2004 |
| WO | WO-0194206 | 12/2001 |
| WO | WO-2004/083559 | 9/2004 |

* cited by examiner

*Primary Examiner* — Jimmy T Nguyen
(74) *Attorney, Agent, or Firm* — Muncy, Geissler, Olds & Lowe, PLLC

(57) ABSTRACT

The present invention relates to a binding apparatus for binding a wire around one or more objects. In particular the present invention relates to a binding apparatus wherein a wire is automatically guided around the object(s). Moreover, the present invention relates to a shaping tool for shaping a wire to have a predetermined curvature.

20 Claims, 6 Drawing Sheets

BINDING APPARATUS

FIELD OF THE INVENTION

The present invention relates to a binding apparatus for binding a wire around one or more objects. In particular the present invention relates to a binding apparatus wherein a wire is automatically guided around the object(s). Moreover, the present invention relates to a shaping tool for shaping a wire to have a predetermined curvature.

BACKGROUND OF THE INVENTION

Binding reinforcement bars in concrete constructions is known to be a costly operation. By manual processes a wire is curled around the iron bars, and by means of a wire cutter the free ends of the wire are twisted.

Resent considerations not only related to the costs of binding the bars but also related to the working environment, has lead to the development of hand-held, portable devices for binding.

EP 0751270 shows a device for binding reinforcement bars for concrete constructions. The device operates by twisting a wire in a loop by a guide arm. A hook thereby binds the reinforcement bars together by twisting the wire loop.

U.S. Pat. No. 4,252,157 shows a device for binding reinforcement bars, comprising a differential gear for transferring torque from a motor to a binding head and a cutting device, respectively.

Both of the above mentioned documents disclose binders having jaws encircling the objects and which are adapted to guide a binding wire in a wire loop around the objects to be tied together. The binders further have twisting means for twisting the wire loop so as to tighten the wire loop around the objects and, thus, to tighten the objects together.

The existing binders generally have circular jaws for guiding the wire in circular loops. This is in contrast to the cross-sectional shape of the objects to be tied together, which objects typically form an oval shape, e.g. when binding two circular iron rods for reinforcing concrete constructions. The result of the circular shaped jaws is typically an excessive overuse of binding wire.

The existing binders further have twisting means arranged to twist the wire loop by gripping the wire loop, e.g. with a rotating hook without previous tightening of the wire in the wire loop. Thereby the tightening force of the wire loop increases as the loop is being twisted and thereby a satisfactory binding force is difficult to achieve.

Another example may be found in EP 1 484 249 which discloses a reinforcing bar machine comprising three motors: a feeding motor, a twisting motor and a sliding motor. The feeding motor forms part of a feeding mechanism and is used to feed the wire. A binding wire twisting mechanism includes the twisting motor and the sliding motor.

Other examples of known binding apparatuses are disclosed in U.S. Pat. No. 5,657,799, EP 0 731 238, EP 0 810 153, EP 0 332 532, EP 0 829 596, U.S. Pat. No. 4,362,192, EP 0 751 270, U.S. Pat. No. 4,252,157, and WO0194206.

BRIEF DESCRIPTION OF THE INVENTION

It is an object of an embodiment of the present invention to provide an improved method and apparatus for binding objects with a reduced amount of wire and an increased binding force.

Moreover, it is an object of an embodiment of the present invention to provide a simpler construction. Furthermore, it is an object of an embodiment of the present invention to provide a construction with as few motors as possible.

Additionally, it is an object of an embodiment of the present invention to provide an apparatus which is lighter.

Accordingly, in a FIRST aspect the present invention relates to a binding apparatus defining a wire path for guiding a wire around one or more objects, the binding apparatus comprising:

- a wire supply for advancing the wire into the wire path; and
- a binding tool forming a passage for the wire into and out of the wire path and being rotatable relative to the wire path, and comprising:
  - a binding head, and
  - an inner tool member slidingly received in the binding head such that the inner tool member and the binding head are locked for relative rotation, the inner tool member being connected to a rotatable spindle such that rotation of the spindle causes the inner tool member to move, axially relative to the binding head, in the direction of a locking position in which the inner tool member is locked for axial movement relative to the binding head, whereby further rotation of the spindle causes concurrent rotation of the inner tool member and the binding head in a first direction relative to the wire path.

The concurrent movement of the inner tool member and the binding head in the first direction relative to the wire path, causes the free ends of a wire piece, which have been guided around the objects by the binding apparatus, to be twisted relative to each other, whereby the wire piece is bound around the object(s). Prior to and/or during said binding process, the wire may be tightened/tensioned such that a tight binding may be provided, i.e. a binding wherein the objects are forced towards each other due to the tensioned wire piece.

At least a part of the binding apparatus may comprise a plastic material such as a reinforced plastic material, metal material such as an acid proof material, a fibre glass material, or any other material suitable to be used in a concreting environment.

The binding apparatus may be used to bind any two (or more) objects together, such as reinforcing bars, tree branches, plastic tubes e.g. heating tubes for floor heating systems, wires etc. As an example, the binding apparatus may be used to secure an element to a larger structure, such as fastening an electrical wire to a structure in order to secure the wire in a predetermined position. It will be appreciated that the binding apparatus may also be used to bind a wire to a single object, e.g. so as to provide a coat-hook or a handle or so as to mark a position on the object.

The wire may be any wire suitable for binding, such as a metal wire e.g. coated with a non-metal material, or a plastic wire or any other wire suitable to be used in the binding apparatus. In one embodiment, the wire may be any wire which is sufficiently rigid to be reshaped/bent to have a predetermined curvature and to maintain said curvature for a period of time of at least 30 seconds, such as 1 minute, such as 2 minutes, such as 5 minutes.

In use, the wire may be provided on a roll which may be inserted into the wire supply, such that the wire may be feed into the binding head during binding of the wire. The wire supply may comprise a motor coupled to feeding rollers for feeding/advancing the wire into the binding head. In one embodiment, the apparatus comprises one set of rollers (each set comprising two opposing rollers between which the wire is provided). In another embodiment, the apparatus comprises plurality of sets of rollers such as two, such as three, such as four, such as five.

The wire supply may comprise one or more sensors such as photo-sensors or mechanical-sensors, for detecting the position of the wire. As an example, a sensor may be provided upstream (relative the feeding direction of the wire) of the feeding rollers such that upon manual insertion of a wire into the wire supply, the rollers may be activated upon detection of a wire by the upstream sensor. When the manually inserted wire meets the rotating rollers, the rollers continue the advancement of the wire until the supplied wire ends.

Moreover, a sensor may be provided downstream the feeding rollers, and the distance between the upstream and the downstream sensors may correspond to the minimum length a wire must have in order to be guided around and bound to one or more objects. Thus, upon user activation of the apparatus, the apparatus may be adapted to determine whether the wire is sufficiently long to perform a binding action, and may prevent the process in case the wire is not sufficiently long.

Either or both of the upstream and downstream sensors may be magnetic sensors arranged to detect the presence of the wire. It will be appreciated, that in order for magnetic sensor to be able to detect the wire, the wire must comprise a magnetic material such a ferromagnetic material. As mentioned above the sensor(s) may be any kind of sensor(s) such as photo-sensors, mechanical-sensors.

Alternatively, or as a supplement, the binding apparatus may comprise a revolution counter adapted to count the number of revolutions made by the feeding rollers. As one revolution of the feeding rollers corresponds to a predetermined length of wire, the revolution counter may be adapted to output a signal corresponding to a wire length. As the rollers are in direct contact with the wire, determination of the number of revolutions will provide a direct measure of the length of the wire which is advanced.

In one embodiment the apparatus comprises a revolution counter and the aforementioned upstream sensors. In the latter embodiment, the apparatus may be adapted to be operated as follows: If during feeding of wire, the upstream sensor is no longer able to detect the wire i.e. the wire supply is empty, the apparatus may, by means of the revolution counter, be adapted to determine the length of the wire which, in connection with the current binding action, has already been feed by means of the rollers. If said length is below a predetermined length e.g. the length needed to perform a binding action, the binding apparatus may be adapted to retract the feed wire and signal to the user, that the wire is not long enough for binding and that a new wire should be inserted into the wire supply.

In one embodiment, the binding apparatus comprises the revolution counter and is adapted to determine the total length of wire already used and the length of the wire remaining in the wire supply. Moreover, the binding apparatus may be adapted to calculate the number of bindings which may be performed by means of the wire remaining in the wire supply. Additionally, the binding apparatus may be adapted to determine an average time elapsing between each binding, and, thus, the time left until the wire must be changed. The latter information may be used by the user to determine whether the remaining wire is long enough to continue until the next break or until the end of the working day.

In one embodiment, the apparatus is adapted to determine/calculate the amount of wire which is needed, and on the basis thereof operate the wire supply such that once the wire has been tightened, the wire is slackened so as to achieve the desired tightness of the wire. It will be appreciated that the tighter the binding is, the more prone the wire/binding will be to breaking/rupturing. Additionally it will be appreciated that the looser the binding is, the higher is the risk that the elements to be bound may move relative to each other in the area of the binding.

In one embodiment the apparatus comprises a processor for controlling one or more of the motors and the sensors. The processor may comprise a memory for storing information. In one embodiment, the processor is adapted to control the motor for feeding the wire, such that the wire is loosened to the desired extend prior to the tying process.

Moreover, a table may be stored in the memory, which table comprises information as to the degree of loosening depending on the length of the wire. The information stored in the table may be stored into the memory prior to the sale of the product e.g. during manufacture. Alternatively, or as a supplement, the user may store the information into the memory during use of the device such that the wire is tightened at a level desired by the user.

In one embodiment, the information is determined by the manufacturer as a result of empiric tests. In yet another embodiment, the processor is adapted to loosen the wire based on a formula such as a formula which approximately provides the same result as the values determined empirically.

The wire supply may be adapted to advance the wire into the wire path, which is the path along which the wire is guided from the binding tool, around the object(s) and back to the binding tool. Said path may be defined by one or more of: a first passage of the binding head, a second passage of the binding head, a first guiding jaw and a second guiding jaw, as is described in further detail below.

The inner tool member is slidingly received in the binding head and may be moved between an initial position and a locking position. When the inner tool member is positioned in the initial position, it may be moved in a first direction, relative to the binding head, whereby it is moved towards the locking position. When inner tool member is positioned in the locking position it is locked for further movement in the first direction, relative to the binding head, but may be moved in the opposite direction, i.e. in the direction of the initial position.

In order to achieve that rotation of spindle causes the inner tool member to move translationally, the inner tool member may be threadedly connected to the spindle, e.g. by means of a single thread or a multiple thread comprising two, three, four five, six, seven or eight threads. In one embodiment, an inner surface of the inner tool member is threaded and arranged to engage a threaded outer surface of the spindle. Alternatively, an inner surface of the spindle may be threaded and arranged to engage a corresponding threaded outer surface of the inner tool member. At least one of the threads may be an ISO-metric thread, a square thread, or a trapezium thread or any other thread suitable to transform the rotation of the spindle to a translational movement of the inner tool member. In one embodiment, the inner tool member is connected to the spindle by means of a ball screw assembly and/or a roller screw.

The binding apparatus may comprise a motor for rotating the spindle. The motor may be an electrical motor and the binding apparatus may comprise a power supply such as a battery, for providing power to the electrical motor. Alternatively, the binding apparatus may comprise a cable for connecting the apparatus to mains or an external battery. The motor may be connected directly to the spindle or via one or more gears.

When the spindle is rotated at least a part of the torque is transferred to the inner tool member, which, thus, must be locked for rotation in order to achieve the translational movement. Accordingly in one embodiment, the binding head, relative to which the inner tool member is locked for rotation, may be partly locked for rotation in a first direction. By partly locked for rotation is meant that the binding head is prevented from rotating in the first direction unless a torque applied to the binding head is above a predetermined threshold. In one embodiment, an adjustable spring determines the predetermined threshold. The spring may be adjustable by the user.

Moreover, the binding head may be locked for rotation in a direction opposite the first direction, relative to the wire path, whereby rotation of the spindle in the opposite direction causes the inner tool member to be moved away from the locking position and towards the initial position.

The binding tool may define a first passage defining an inlet and an outlet, and a second passage defining an outlet. In one embodiment, the wire supply is adapted to advance the wire through the first passage by advancing the wire into the inlet and out of the outlet, and back into the inlet of the second passage so as to guide the wire around the object(s). During movement between the outlet of the first passage and the inlet of the second passage, the wire may follow the wire path.

The binding apparatus may comprise a cutting tool which is arranged to cut the wire during movement of the inner tool member towards the locking position. In one embodiment, the tool member is adapted to cut the wire inside the first passage or in an area of the inlet of the first passage. The cutting tool may comprise a first cutting edge which during cutting is moved towards either a second cutting edge or a contact surface, through a substantially non-rotational movement, such as a substantially pure translational movement in the direction of the locking position. The first cutting edge and one of the second cutting edge and the contact surface may be adapted to be moved directly towards each other or may be arranged to slide past each other like the cutting edges of a scissor. When the a wire is inserted through the first passage and received in the second passage, cutting of the wire causes a piece of wire to be separated from the wire of the wire supply. Said wire piece comprises a cut end and a feed end. Subsequently to the cutting action, the cut end may be positioned in the first passage or in the area of the inlet of the first passage, and the feed end may be positioned in the second passage. In an embodiment, the first cutting edge is defined by the inner tool member. In a further embodiment, the second cutting edge or the contact surface may be defined by a guiding member for guiding the wire into the first passage.

In order to ensure that the wire which has passed through the first passage is received in the second passage, at least a part of the wire part may be defined by one or more guiding jaws. In one embodiment, the binding apparatus comprises at least one of a first and a second guiding jaw. The first and second guiding jaws may be spaced apart such that an object to be bound may be inserted into a cavity defined by the first and second guiding jaw, e.g. by moving the binding apparatus in over the object(s). Due to the gap between the first and second guiding jaw, the first guiding jaw may be adapted to guide a wire from the first guiding jaw to the second guiding jaw. During use, the feed end of the wire is feed from the outlet of the first passage on to a first guiding surface of the first guiding jaw, upon further feeding of the wire the feed end slides along the first guiding surface and leaves the first guiding jaw whereby the feed end is advanced in free air. However, due to the shape of the first guiding jaw/surface, the feed end of wire is guided in the direction of the second guiding jaw and finally received in by the second guiding jaw. Subsequently, the second guiding jaw guides the feed end into the inlet of the second passage.

In one embodiment, at least one of the first and second guiding jaw is adapted to be rotated between a first and a second position such that when positioned in the first position, an object to be tied is encircled by the binding apparatus and such that when positioned in the second position an object to be tied may be advanced into a binding position by being moved through a passage defined between end surfaces the first and second guiding jaws. Each of the rotatable guiding jaws may be biased towards the first position and may comprise means for forcing it into the second position. Such means may be an inclined surface provided at the end surfaces of the first and/or the second guiding jaw.

Moreover, the first and/or second guiding jaws may be releasable reattachable to the binding apparatus, so as to allow a user to replace jaws.

The first and second passage may be arranged with respect to each other, such that a wire feed out of the first passage must be reshaped, such as bend, in order to be received in the second passage. Accordingly, at least a part of the wire path may be defined by a shaping tool adapted to shape the wire when advanced through the shaping tool, so as to allow the wire to be received in the second passage of the binding tool. The shaping tool may be defined by one or more of the binding tool and the first guiding jaw. In order to reshape/bend the wire, the shaping tool may comprises at least three shape-defining surfaces which are arranged with respect to each other, such that the wire is formed so as to have with a predetermined curvature, when the feed end of the wire is moved translationally into the shaping tool. In one embodiment, at least one shape-defining surfaces is movable in relation to at least one other shape-defining surface, so as to change the curvature of a wire feed through the shaping tool. At least one of the inner tool member, the binding head and the first guiding jaw, may define at least one guiding surface adapted to guide the wire from the wire supply and into the shaping tool.

In order to allow the wire to be tightened around the object(s) the shaping tool may be shaped such that upon tightening of the wire, the wire is brought out of engagement with the shaping tool, whereby the wire may be tightened around at least a part of the one or more objects. In one embodiment, the shaping tool may comprise a pawl mechanism allowing the wire to be brought out of engagement with the shaping tool. In another embodiment tightening of the wire causes the wire to be moved sideward's out of engagement with the shaping tool as is described in further detail in the description of the figures.

When the feed end has been received in the second passage, the binding apparatus may be adapted to tighten the wire. Accordingly, to prevent that said tightening of the wire causes the feed end to be pulled out of the second passage, the second passage may comprise a retainer for preventing movement of the feed end in a direction opposite the insertion direction. As the second passage is at least partly defined by the binding tool, the retainer, the inner tool member and/or the binding head comprise(s) the retainer. However subsequent to binding the wire piece, the feed end should preferable be moved out of engagement with the retainer and, thus, the retainer may be adapted to allow the feed end to be (re)moved in a direction transverse to the insertion direction, whereby the feed end is moved out of engagement with the retainer. In one embodiment the removal direction defines an angle of 45-90 degrees relative to the insertion direction, such as 60-90, such as 80-90 degrees.

The inner tool member and/or the binding head may be adapted to retain the cut end of the wire piece, by moving the inner tool member into the locking position, whereby the cut end is prevented from being retracted from the first passage.

In one embodiment, the inner tool member comprise a first retaining surface and the binding head comprises a second retaining surface, and the cut end is retained in the first passage when said cut end is positioned between and in contact with the first and second retaining surface, and said surfaces are forced towards each other.

When the cut end is retained between the first and second retaining surfaces, further axial movement of the inner tool member relative to the binding head is prevented, and further rotation of the spindle causes the inner tool member and the binding head (the binding tool) to rotate together as described previously. In one embodiment, the rotation of the binding tool is caused by rotational forces applied from the thread of the spindle to the inner tool member. When the inner tool member is not positioned in the locking position, such rotational forces causes the inner tool member to be moved axially due to the thread, but when the inner tool member is positioned in the locking position, axial movement is prevented whereby the binding tool will rotate. Alternatively, or as a supplement, the inner tool member may comprise an abutment surface adapted to engage a corresponding abutment surface of the binding head when the inner tool member is positioned in its locking position, such that rotation of the inner tool member is transferred to the binding head via the abutting surfaces.

In some embodiments, the geometry of the first and the second passage causes the feed end and the cut end to intersect each other whereby at least a part of the binding tool is encircled and, thus, trapped by the wire ends. As such wires may be relatively stiff, a user must apply relatively large forces to remove the binding apparatus. Accordingly in one embodiment, the inner tool member and/or the binding head is/are adapted to reshape at least one the cut end and the feed end upon movement of the inner tool member away from its locking position, such that the wire ends do not intersect each other and/or such that the binding tool is not trapped by the wire ends. Upon such reshaping, the binding apparatus may be easily removed by the user.

In one embodiment, the binding apparatus comprises one or more spacers for ensuring a distance between the binding tool and the objects to be tied. The spacers provide the advantage that the tightness of the binding may be controlled, in embodiments wherein the binding tool during binding is adapted to be rotated a predetermined number of times relative to the wire path, such as one, two, three, four, five, or six. It will be appreciated that the closer the objects are to the binding tool, the tighter the binding will be and vice versa.

At least one of the spacers may define grooves/indentations adapted to receive the object to be bound. In one embodiment, the groove is defined in a surface facing the object to be bound during operation. The groove may extend in a direction transverse to the spacer e.g. such that an object received in the groove extends through axis of rotation of the spindle and the inner tool member.

In another embodiment the binding apparatus is adapted to tighten the wire as much as possible, and subsequently loosen the wire so as to provide the desired tightness of the binding.

In a SECOND aspect the present invention relates to a jaw for a binding tool, the jaw comprising a shaping tool for shaping a wire to have a predetermined curvature, the shaping tool comprising at least three shape-defining surfaces which are arranged with respect to each other, such that a wire which is moved translationally into the shaping tool is reshaped so as to define a predetermined curvature.

The jaw tool according to the second aspect of the invention may comprise any feature or element according to the first aspect of the invention. As an example, the shaping tool may be shaped such that upon tightening of a wire received in the tool, the wire is brought out of engagement with the shaping tool.

In a THIRD aspect the present invention relates to a binding apparatus defining a wire path for guiding a wire around one or more objects, the binding apparatus comprising:

a wire supply for advancing the wire into the wire path; and a binding tool forming a passage for the wire into and out of the wire path and being rotatable relative to the wire path, wherein the wire supply comprises a sensor for determining a length of at least a part of the wire.

The binding apparatus may be adapted to prevent a binding action if the wire of the wire supply is shorter than a predetermined length, such as a minimum wire-length required for a binding action. In one embodiment, the apparatus is adapted to signal to a user that the wire of the wire supply does not have the specified length to perform a binding action. The signal may be an audio signal and/or a visual signal and/or a tactile signal.

The binding apparatus according to the third aspect may comprise any feature or element according to the first aspect of the invention.

DESCRIPTION OF THE FIGURES

The invention will now be described in further detail with reference to the drawings in which:

FIGS. 1-9 disclose a binding apparatus 100 defining a wire path and comprising a wire supply 160 (cf.

Figure 1:
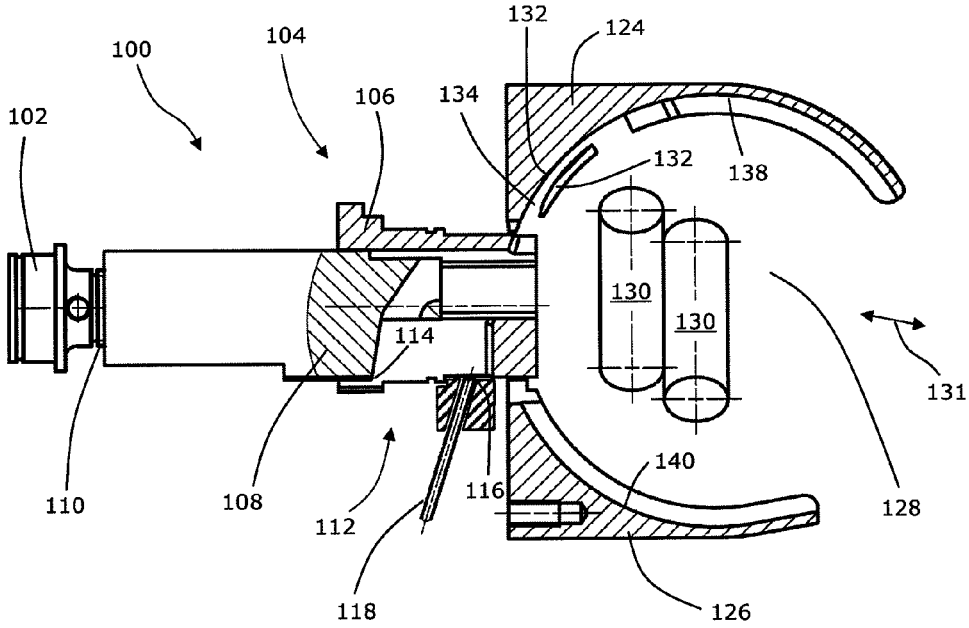
FIG. 1 discloses a binding apparatus prior to operation.

The inner surface (not shown) of the inner tool member 108 is threaded and engages a threaded outer surface 110 of the spindle 102, such that rotation of the spindle 102 causes the inner tool member 108 to move axially (to the right in the drawing) relative to the binding head 106 and towards a locking position (shown in FIG. 7) in which the inner tool member 108 is locked for axial movement relative to the binding head 106 whereby further rotation of the spindle 102 causes concurrent rotation of the inner tool member 108 and the binding head 106.

The binding apparatus 100 further comprises a cutting tool 112 comprising a first cutting edge 114 and a contact surface 116. The first cutting edge 114 and the contact surface 116 are arranged to perform a cutting action when the first cutting edge 114 slides past the contact surface 116. During said cutting action, the first cutting edge 114 is forced in the direction indicated by arrow 117, such that a wire 118 feed into a first passage 120 is forced into contact with the contact surface 116 which prevents the wire 118 from moving in the direction of arrow 117, whereby further movement of the first cutting edge 114 courses the wire 118 to be cut.

The wire supply 160 (cf. FIG. 10) is arranged to supply the wire 118 through the first passage 120 and back into a second passage 122 via a first guiding jaw 124 and a second guiding jaw 126. At least a part of the wire path is defined by the first and second guiding jaws (124,126). The first and second guiding jaws 124,126 together define a cavity 128 wherein one or more objects 130, such as reinforcing bars, may be positioned so as the bind the one or more objects 130 together by means of the binding apparatus 100. In order to allow the objects to be positioned in the cavity 128, a part of the wire path is "broken", such that when the wire 118 is not feed from the first to the second guiding jaw 124,126, the objects 130 may be moved into the cavity 128, and such that when the wire 118 is feed from the first guiding jaw 124 to the second guiding jaw 126, the objects 130 cannot be moved into or out of the cavity 128 as the wire 118 prevents such movement.

Moreover, the first guiding jaw 124 comprises a shaping tool 132 adapted to shape/bend the wire 118 when feed through a passage 134 of shaping tool 132. The shaping tool 132 is adapted to shape/bend the wire 118 to have a curvature allowing the wire 118 when feed from the first guiding jaw 124 to be received by the second guiding jaw 126 and further into the second passage 122.

In FIG. 1 discloses an initial position wherein the first and second guiding jaws 124,126 are positioned around the objects 130 such that the objects are positioned in the cavity 128. The inner tool member 108 is positioned in an initial position, wherein it is retracted relative to the binding head 106 (i.e. positioned to the left in the drawing). The wire 118 abuts the second cutting edge 116 and is ready for insertion into the first passage 120, cf. FIG. 2.

Figure 2:
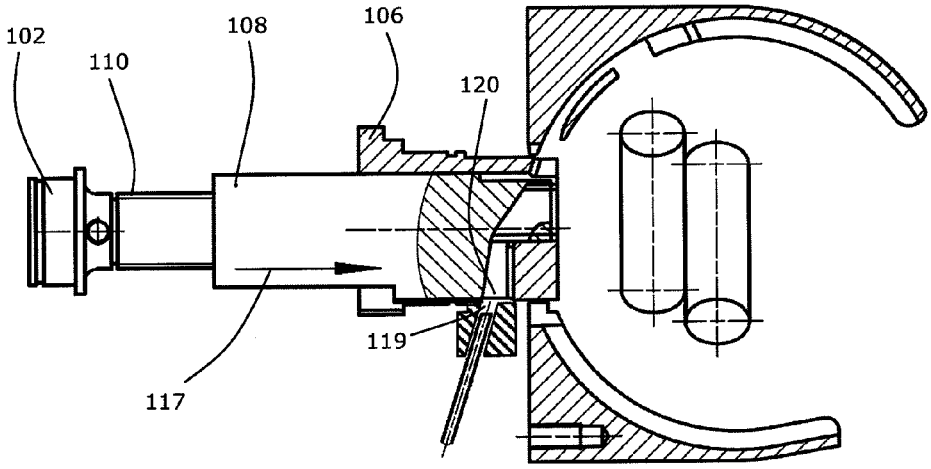
FIGS. 2-5 disclose the process of feeding the wire into and around objects to be bound, FIGS. 6-8 disclose the process of binding the wire, FIG. 9 discloses removal of the binding apparatus, FIG. 10 discloses a wire supply according to the invention, and FIGS. 11*a*-11*d* disclose a binding apparatus comprising spacers.
Figure 7:
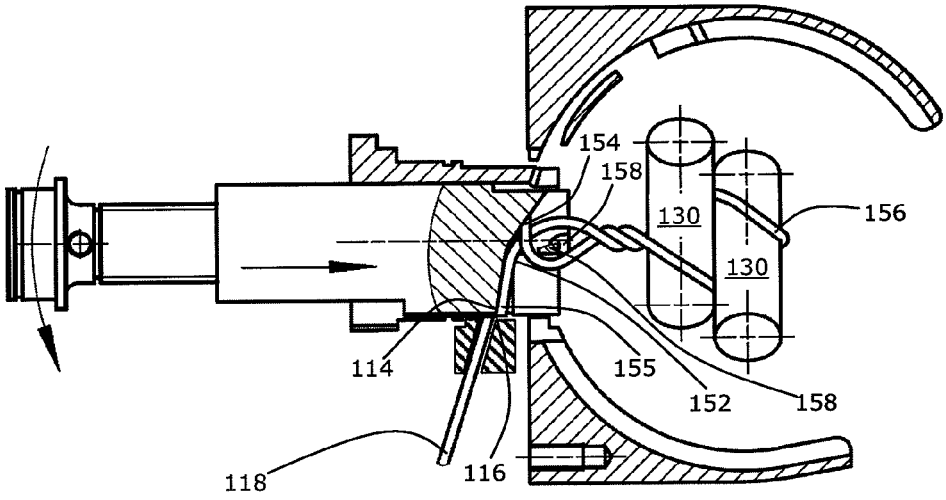

In FIG. 2 the spindle 102 is rotated in a first rotational direction whereby the threaded engagement between the outer surface of the spindle 102 and the inner surface of the inner tool member 108 causes the inner tool member 108 to be moved axially (i.e. to the right in the drawing) relative to the binding head 106 and in the direction of (but not into) a locking position (cf. FIG. 7). In order to prevent the binding head 106 from rotating with the spindle 102, the binding head 106 is partially locked for rotation relative to the wire path. The partial lock is adapted to prevent said relative rotation, as along as a torque applied to the binding head is below a predetermined threshold and has a direction opposite the first rotational direction. Accordingly, if the torque is above the predetermined threshold and in the direction of the first rotational direction, the binding head 106 may be rotated. Accordingly, the inner tool member is in its locking position, rotation of the spindle 102 cannot be transformed into translational movement of the inner tool member, whereby the torque needed to rotate the spindle 102 must exceed said predetermined threshold in order to allow the spindle to be rotated further. This is described in further detail in relation to FIG. 7.

Figure 3:
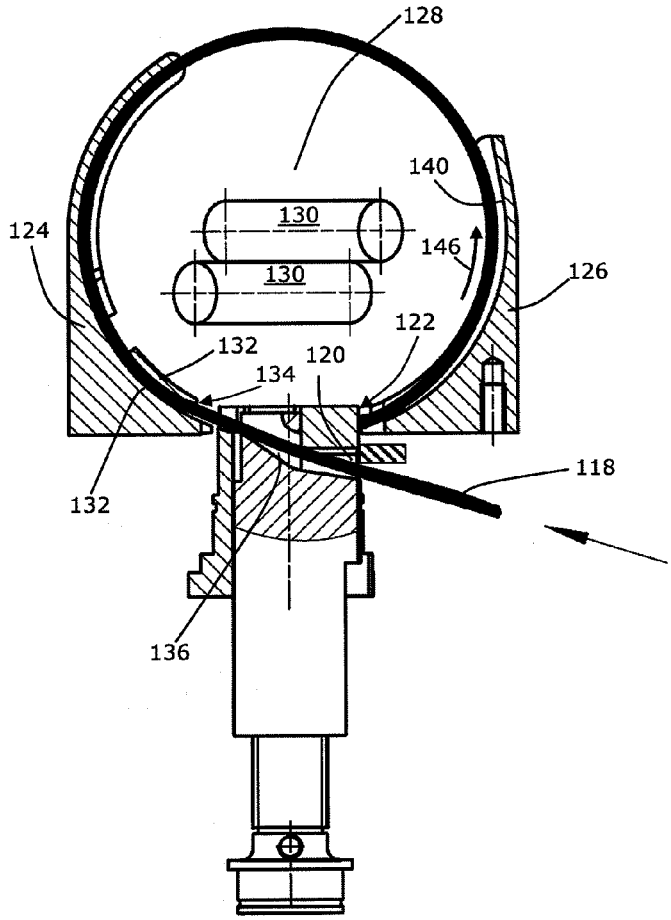
Figure 4:
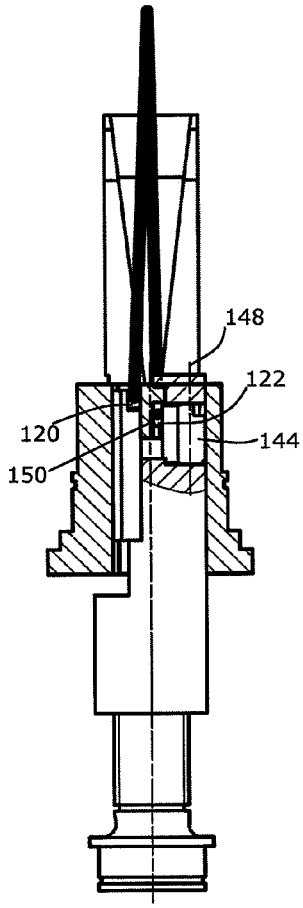
Figure 5:
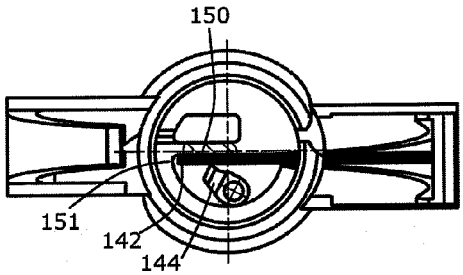
Figure 10:
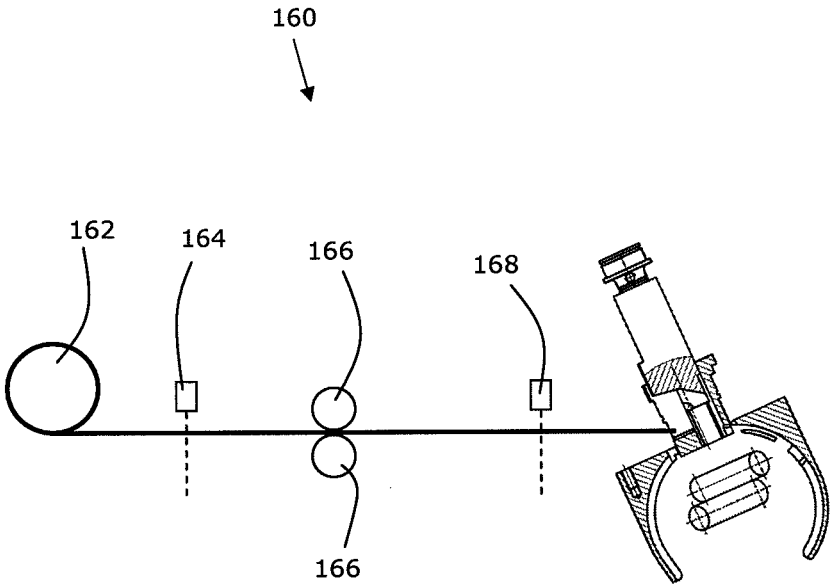
FIG. 10), a rotatable spindle 102, and a binding tool 104. The binding tool 104 comprises a binding head 106 and an inner tool member 108 which is slidingly received in the binding head 106 such that the inner tool member 108 and binding head 106 are locked for relative rotation of one relative to the other.
Figure 11A:
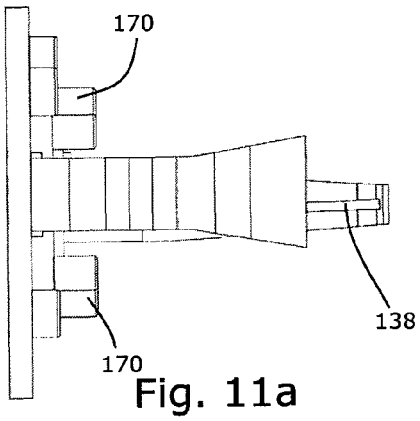
Figure 11B:
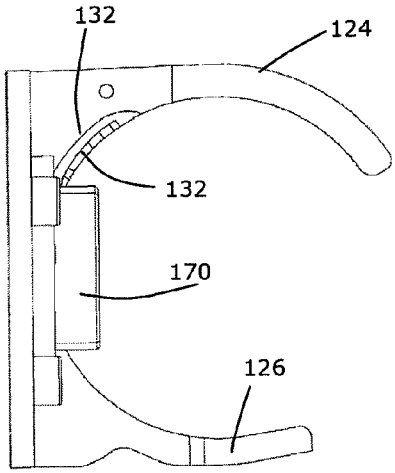
Figure 11D:
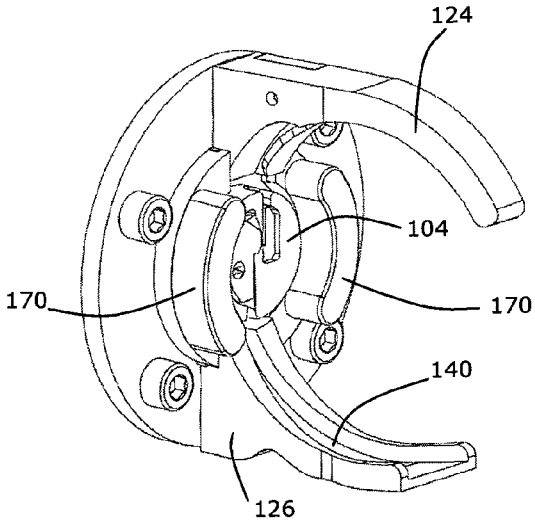
Figure 11C:
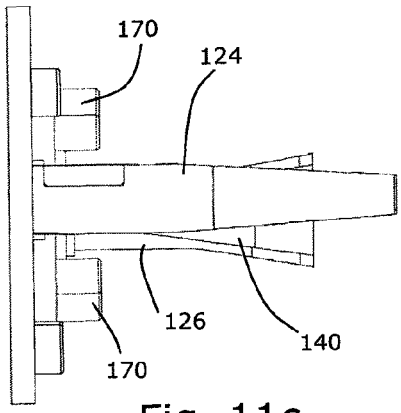

In FIGS. 3-5 the wire supply 160, which is described in relation to FIG. 10, advances the wire 118 into the first passage 120 wherein a guiding surface 136 guides the wire 118 into the passage 134 of the shaping tool 132 which shapes/bends the wire 118 to have a curvature corresponding to the curvature of the first and second guiding jaws 124,126. Subsequently, the wire 118 follows a first guiding surface 138 of the first guiding jaw 124. Due to the reshaping of the wire 118 provided by the shaping tool 132, the wire 118 is received by the second guiding jaw 126, and slides along a second guiding surface 140 of second guiding jaw 126 until the wire 118 is received in the second passage 122. Upon further feeding of the wire 118, the wire end 142 is moved into engagement with a retainer in the form of a pawl 144 which locks the wire for movement in the reverse direction as indicated by arrow 146. The pawl 144 is pivotable about a retainer axis 148 and a spring (not shown) urges the pawl 144 towards the sidewall 150. The wire end 142 is retained between the pawl 144 and the sidewall 150 and reverse movement of the wire (in the direction of the arrow 146) urges the retainer towards the wire and the sidewall. The wire 118 is prevented from further advancement into the second passage 122 when a feed end 154 abut a stopping surface 151, and the wire supply 160 halts the feeding process, as is described in relation to FIG. 10.

Figure 6:
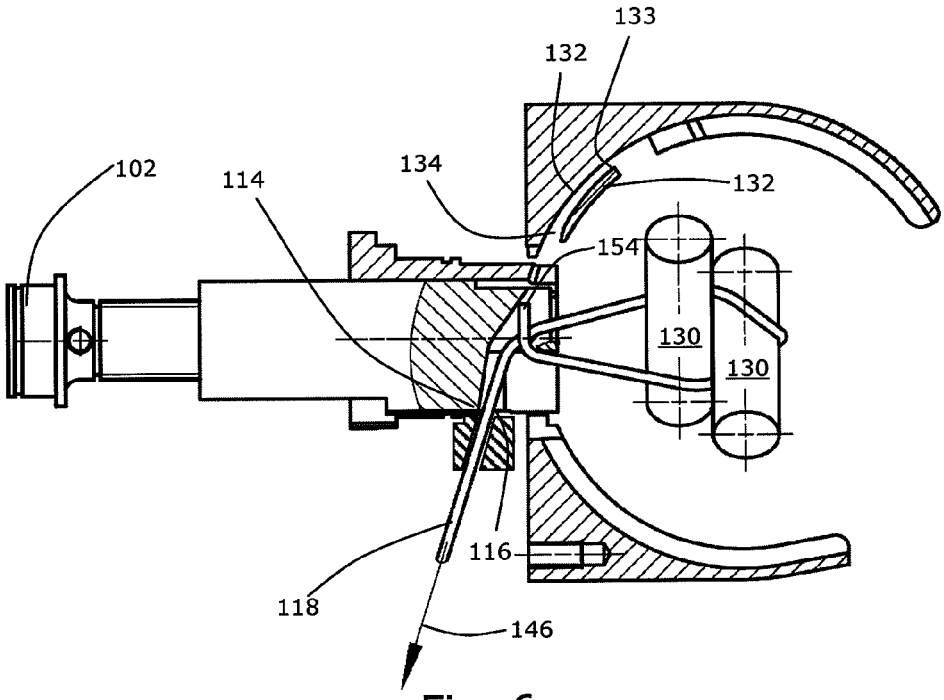

In FIG. 6 the wire supply 160 pulls the wire 118 in the reverse direction, as indicated by arrow 146. This tightens the wire 118, whereby the wire 118 is pulled out of the passage 134 of the shaping tool 132 and is tightened around a part of the objects 130. In order to achieve this, the shaping tool 132 may be open in one side, i.e. in a direction into or out of FIG. 6. Moreover, a downstream surface 133 of the shaping tool may be designed to force the wire 118 towards the open side upon tightening of the wire 118. With the wire 118 tightened around the reinforcing bars 130, the spindle 102 is rotated whereby the inner tool member 108 is moved into its locking position as illustrated in FIG. 7. During said movement the wire 118 is cut by the first cutting edge 114 and the contact surface 116, whereby a wire piece 156 is produced, said wire piece 156 has a feed end 154 and a cut end 155. When the inner tool member 108 is positioned in the locking position, the wire 118 is retained between the inner tool member 108 and the abutment surface 152. With the inner tool member 108 in its locking position, further rotation of the spindle 102 causes the inner tool member 108 and binding head 106 to rotate, when the torque applied to the spindle exceeds the predetermined threshold. Upon said rotation, the wire is twisted as the feed end 154 and the cut end 155 are retained in the binding tool 104.

Figure 8:
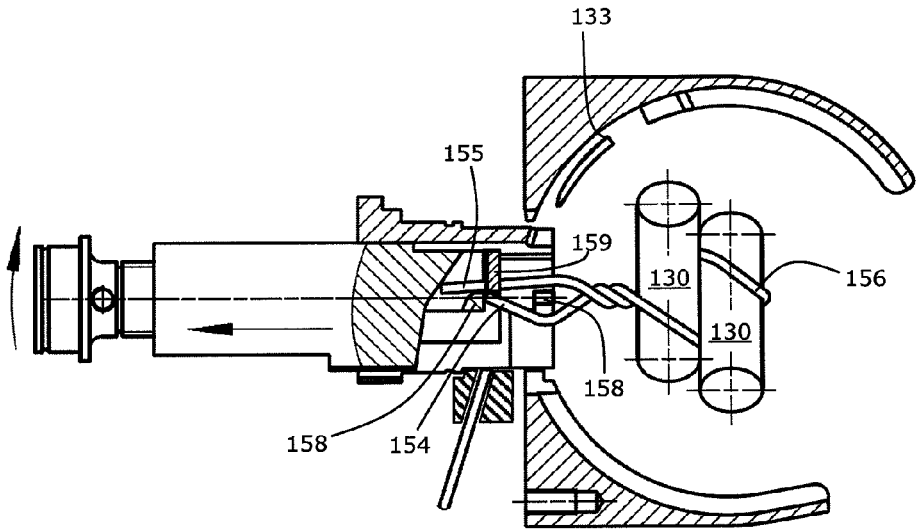
Figure 9:
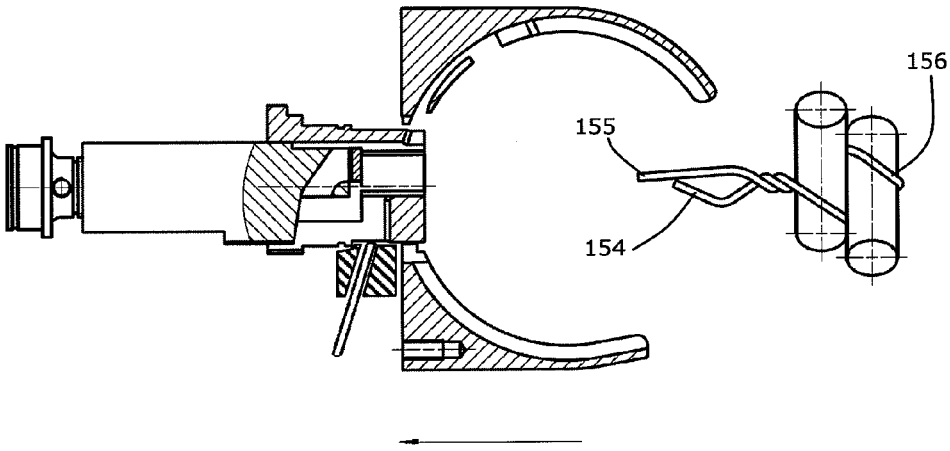

With the objects 130 bound to each other, the spindle 102 is rotated in the opposite direction as illustrated in FIG. 8. As the binding head 106 is prevented from rotating in the opposite direction, rotation of the spindle in said direction causes the inner tool member 108 to be moved away from its locking position, whereby the ends 154,155 of the wire piece 156 are straightened out due to the elements 158,159. Subsequently the binding apparatus 100 may be removed as shown in FIG. 9.

An embodiment of the wire supply 160 is illustrated in FIG. 10. The wire supply 160 comprises a wire coil 162, a first sensor 164, feeding rollers 166 and a second sensor 168. When the wire supply 160 is empty, the wire 118 may be feed into the wire supply 160, so as to allow the wire 118 to be received by the feeding rollers 166. Prior to receipt of the wire 118 by the rollers 166, the first sensor 164 detects the presence of a wire 118, whereby a motor (not shown) causes the rollers to rotate. When the wire 118 is received by the rollers 166, the rollers are rotated until the wire 118 is detected by the second sensor 168 and the further advancement of the wire is halted, when the free end is in the correct feeding position.

Upon initiation of a user of the binding apparatus, the motor is operated whereby the rollers rotate and the wire 118 is feed via the wire path into the second passage 122 as described above. When the wire end abuts the stopping surface 151 of the second passage the wire is prevented from being advanced further and the current in the electrical circuit connected to the motor increases. Accordingly, when the control system controlling the motor detects such an increase in the current, the rotational direction of the motor (rollers) are reversed in order to tighten the wire as described in relation to FIG. 6. In an alternative embodiment, the number or revolutions of the rollers are used to determine whether the wire has been advanced sufficiently to be received in the second passage 122.

The binding apparatus comprises a revolution counter adapted to count the number of revolutions made by the feeding rollers 166. As one revolution of the feeding rollers 166 corresponds to a predetermined length of wire 118, the revolution counter is adapted to output a signal corresponding to a wire length.

The apparatus 100 is adapted to be operated as follows: If during feeding of wire 118 the first sensor 164 is no longer able to detect the wire 118 i.e. the wire supply is empty, the apparatus is, by means of the revolution counter, be adapted to determine the length of the wire 118 which, in connection with the current binding action, has already been feed by means of the rollers 166. If said length is below a predetermined length e.g. the length needed to perform a binding action, the binding apparatus is adapted to retract the feed wire 118 and signal to the user, that the wire 118 is not long enough for binding and that a new wire should be inserted into the wire supply.

FIGS. 11*a*-11*d* disclose a binding apparatus 100 comprising two spacers 170, which during binding are used to provide a predetermined distance between the objects and the binding head. By providing a predetermined distance the tightness of the bindings may be controlled, as it will be appreciated that the longer the distance is the more loose the binding is, and the shorter the distance is the tighter the binding is, for the same size of objects 130. Accordingly, a user may advance the binding apparatus into a position wherein one or more of the objects 130 abut the spacers 170, whereby the predetermined distance between the binding tool 104 and the objects 130 is ensured.

In a first embodiment the axial extent of the spacers is adjustable. The adjustability may be ensured by providing a plurality of interchangeable sets of spacers each having different lengths. Alternatively, the spacers may be adapted to be moved axially between two positions between which the spacers may be positioned in order to achieve the desired tightness of the bindings. The user may adjust the adjustable spacers manually or automatically by means of a motor.

In a second embodiment the spacers are provided in a predetermined length and the tightness of the binding is controlled by adjusting the tightening of the wire either manually or automatically. In order to control the tightening of the wire the apparatus may be adapted to tighten the wire as much as possible and subsequently loosen the wire in order to achieve the desired tightness. The apparatus may be adapted to allow the user to adjust the tightening/loosening of the wire manually or automatically. The latter may be achieved by the following steps which the apparatus may be adapted to carry out:

In a first step, a predetermined length of wire is advanced out though the binding head. When the wire end is received by the wire head after having been guided around the objects 130, the wire end is retained and the wire is tightened by retracing the wire as much as possible.

In a second step, the length of the retracted part of the wire is determined (i.e. it is determined how much wire can be retracted until the wire is as tight as possible). It will be appreciated that the longer the retracted wire is the smaller the objects are, and the shorter the retracted wire is the larger the objects are. Thus, the apparatus may be adapted to determine how much the wire need to be loosened in order to ensure a desired tightness of the binding for any size of the object(s).

In a third step the wire is loosened in order to ensure the desired tightness of the binding.

The invention claimed is:

1. A binding apparatus defining a wire path for guiding a wire around one or more objects, the binding apparatus comprising:

a wire supply for advancing a first free end of the wire into the wire path; and a binding tool forming a passage for the wire into and out of the wire path and being rotatable relative to the wire path, and comprising:

a binding head, and an inner tool member slidingly received in the binding head such that the inner tool member and the binding head are locked for relative rotation of one relative to the other whereby any rotation of the inner tool member causes the binding head to rotate concurrently, the inner tool member being threadingly connected to a rotatable spindle such that rotation of the spindle in a first direction relative to the wire path causes the inner tool member to move, axially relative to the binding head, in the direction of a locking position wherein the inner tool member is locked for further axial movement relative to the binding head and wherein a second free end of the wire is retained between the binding head and the inner tool member, whereby further rotation of the spindle in the first direction causes rotation of the inner tool member and thereby concurrent rotation of the binding head without axial movement of the inner tool member, the inner tool member and the binding head rotating in a first direction relative to the wire path thus causing the first and second ends of the wire, which have been guided around the objects by the binding apparatus, to be twisted relative to each other, whereby the wire is bound around the objects, and wherein the binding head is locked for rotation in a direction opposite the first direction, whereby rotation of the spindle in the opposite direction causes the inner tool member to be moved away axially from the locking position.

2. The binding apparatus according to claim 1, wherein the wire supply is arranged to advance the wire through a first passage and back into a second passage via the wire path, the first and second passages being defined by the binding tool.

3. The binding apparatus according to claim 1, further comprising a cutting tool which is arranged to cut the wire during movement of the inner tool member towards the locking position.

4. The binding apparatus according to claim 1, wherein the cutting tool comprises a first cutting edge which during cutting is moved towards one of a second cutting edge and a contact surface, through a substantially non-rotational movement.

5. The binding apparatus according to claim 4, wherein the inner tool member defines the first cutting edge.

6. The binding apparatus according to claim 1, wherein at least a part of the wire path is defined by one or more guiding jaws.

7. The binding apparatus according to claim 6, wherein at least a part of the wire path is defined by a shaping tool adapted to shape the wire when advanced through the shaping tool, so as to allow the wire to be received in the second passage of the binding tool.

8. The binding apparatus according to claim 7, wherein the shaping tool comprises at least three shape-defining surfaces which are arranged with respect to each other, such that the wire is formed so as to have with a predetermined curvature, when the wire is moved translationally into the shaping tool.

9. The binding apparatus according to claim 7, wherein at least one of the inner tool member and the binding head define at least one guiding surface adapted to guide the wire from the wire supply and into the shaping tool.

10. The binding apparatus according to claim 7, wherein a first guiding jaw of the one or more guiding jaws is arranged to guide the wire into the shaping tool.

11. The binding apparatus according to claim 10, wherein a second guiding jaw of the at least one guiding jaw is arranged to receive the wire when feed from the first guiding jaw and to guide the wire into the second passage.

12. The binding apparatus according to claim 2, wherein at least one of the inner tool member and the binding head comprise a retainer adapted to retain a feed end of the wire, upon insertion, in an insertion direction, of said end into the second passage, such that movement of the feed end in a direction opposite the insertion direction is prevented.

13. The binding apparatus according to claim 12, wherein the retainer is adapted to allow the feed end to be moved in a direction transverse the insertion direction whereby the feed end is moved out of engagement with the retainer.

14. The binding apparatus according to claim 1, wherein at least one of the inner tool member and the binding head is adapted to retain a cut end of a wire piece which is cut from the wire and which comprises the cut end and the feed end, by moving the inner tool member into the locking position, whereby the cut end is prevented from being retracted from the first passage.

15. The binding apparatus according to claim 1, wherein the inner tool member comprises an abutment surface adapted to engage a corresponding abutment surface of the binding head when the inner tool member is positioned in its locking position, such that rotation of the inner tool member is transferred to the binding head via the abutting surfaces.

16. The binding apparatus according to claim 14, wherein at least one of the inner tool member and the binding head is adapted to reshape at least one the cut end and the feed end upon movement of the inner tool member away from its locking position.

17. The binding apparatus according to claim 6, wherein the shaping tool is shaped such that upon tightening of the wire, the wire is brought out of engagement with the shaping tool, whereby the wire may be tightened around at least a part of the one or more objects.

18. The binding apparatus according to claim 8, wherein at least one of the inner tool member and the binding head define at least one guiding surface adapted to guide the wire from the wire supply and into the shaping tool.

19. The binding apparatus according to claim 15, wherein at least one of the inner tool member and the binding head is adapted to reshape at least one the cut end and the feed end upon movement of the inner tool member away from its locking position.

20. The binding apparatus according to claim 1, wherein a single drive source rotates the rotatable spindle.

* * * * *

UNITED STATES PATENT AND TRADEMARK OFFICE

CERTIFICATE OF CORRECTION

PATENT NO. : 8,607,696 B2
APPLICATION NO. : 12/743710
DATED : December 17, 2013
INVENTOR(S) : Jensen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 233 days.

Signed and Sealed this
Twenty-second Day of September, 2015

Michelle K. Lee

Michelle K. Lee
*Director of the United States Patent and Trademark Office*